US011469524B2

(12) United States Patent
Oshima et al.

(10) Patent No.: US 11,469,524 B2
(45) Date of Patent: Oct. 11, 2022

(54) POLARIZED WAVE SHARED ARRAY ANTENNA AND METHOD FOR MANUFACTURING THE SAME

(71) Applicant: NEC CORPORATION, Tokyo (JP)

(72) Inventors: Naoki Oshima, Tokyo (JP); Keiichi Motoi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 76 days.

(21) Appl. No.: 17/032,171

(22) Filed: Sep. 25, 2020

(65) Prior Publication Data

US 2021/0098895 A1 Apr. 1, 2021

(30) Foreign Application Priority Data

Sep. 26, 2019 (JP) ..... JP2019-174875

(51) Int. Cl.
*H01Q 21/24* (2006.01)
*H01Q 9/04* (2006.01)

(52) U.S. Cl.
CPC ..... *H01Q 21/24* (2013.01); *H01Q 9/0407* (2013.01)

(58) Field of Classification Search
CPC ..... H01Q 9/04; H01Q 9/0407; H01Q 9/0435; H01Q 9/045; H01Q 21/06; H01Q 21/065; H01Q 21/24
See application file for complete search history.

(56) References Cited

U.S. PATENT DOCUMENTS

2019/0221947 A1* 7/2019 Zihir ..... H01Q 21/245
2020/0153116 A1* 5/2020 Onaka ..... H01Q 21/24
2020/0412025 A1* 12/2020 Oshima ..... H01Q 5/35
2021/0098895 A1* 4/2021 Oshima ..... H01Q 21/065

FOREIGN PATENT DOCUMENTS

JP 2000-508144 A 6/2000
JP 2019-047238 A 3/2019

* cited by examiner

*Primary Examiner* — Jason Crawford
(74) *Attorney, Agent, or Firm* — Sughrue Mion, PLLC

(57) ABSTRACT

A polarized wave shared array antenna 10A includes: planar antennas 11*a* and 11*b*, each of which generating two polarized waves of first and second polarized waves orthogonal to each other; feeding points 12*a* and 12*b* for generating the first polarized wave, which are provided in the planar antenna 11*a*, and feeding points 14*a* and 14*b* for generating the second polarized wave, which are provided in the planar antenna 11*b*; and an integrated circuit 20 including transmission and reception units 21*a*, 21*b*, 22*a*, and 22*b* connected to the respective feeding points 12*a*, 12*b*, 14*a*, and 14*b* via wirings, in which in a plan view, with respect to an axis A1, the feeding points 12*a* and 14*a*, respectively, are disposed symmetrical to the feeding points 12*b* and 14*b*, and the transmission and reception units 21*a* and 22*a*, respectively, are disposed symmetrical to the transmission and reception units 21*b* and 22*b*.

3 Claims, 7 Drawing Sheets

POLARIZED WAVE SHARED ARRAY ANTENNA AND METHOD FOR MANUFACTURING THE SAME

INCORPORATION BY REFERENCE

This application is based upon and claims the benefit of priority from Japanese patent application No. 2019-174875, filed on Sep. 26, 2019, the disclosure of which is incorporated herein in its entirety by reference.

TECHNICAL FIELD

The present disclosure relates to a polarized wave shared array antenna and a method for manufacturing the same.

BACKGROUND ART

The rapid spread of radio communication has led to a problem that there is a shortage in frequency bands used for radio communication. One of techniques for effectively using a frequency band is beamforming. Beamforming is a technique in which interference with other radio systems is prevented while signal quality is maintained by radiating radio waves having directivity, thereby enabling radio communication with a predetermined communication target.

A typical technique for achieving beamforming is phased array. Phased array is a technique for enhancing a signal in a desired direction by adjusting the phases of radio signals fed to a plurality of planar antennas in a transmitter and combining radio waves radiated from each of the planar antennas in space.

In recent years, an integral-type module in which a planar antenna such as a patch antenna and a high-frequency unit of a transceiver are mounted on each of both sides of a substrate has been receiving attention in terms of reducing the size of an antenna module. It is desired that a plurality of planar antennas in the phased array be disposed at intervals of about a half wavelength of a carrier wave. Therefore, as the frequency becomes higher, the intervals between the antennas become shorter. Consequently, the size of the above-described integral-type module becomes small.

Giving a millimeter-wave band as an example, the half wavelength is 5 mm at 30 GHz (a wavelength of 10 mm), and the half wavelength is 2.5 mm at 60 GHz band (a wavelength of 5 mm). It is necessary to mount a transmission and reception unit in these about half-wavelength regions in order to implement an integral-type module, and accordingly it becomes essential to integrate a plurality of transceivers including a phase shifter.

Further, in the phased array, if the characteristics of the individual arrays deviate from the assumed weighting of phases, the beam deviates from the desired direction. Therefore, it is desired that the wiring layouts of all arrays from the transmission and reception unit to the feeding point of an antenna have the same shape.

Japanese Unexamined Patent Application Publication No. 2019-047238 discloses two four-element arrays, each of which is composed of four radiating elements. One of these arrays is formed on each of the two sub-arrays, and power is supplied by running feed lines between the four element arrays and wiring one of the feed lines to each radiating element, the wirings being equal in length to each other. In Japanese Unexamined Patent Application Publication No. 2019-047238, in order to reduce the number of side lobes, feeding points to the two sub-arrays are provided at both ends of a printed circuit board and the directions in which power is supplied to the two sub-arrays are made opposite to each other. Further, Published Japanese Translation of PCT International Publication for Patent Application, No. 2000-508144 discloses a technique for reducing leakage to orthogonal polarized waves by arranging feeding points at a mirror symmetrical position in a two-polarized-waves shared patch antenna.

Polarization diversity and polarization multiple-input and multiple-output (MIMO) that use two types of orthogonal polarized waves may be used in order to improve communication quality. When two types of polarized waves are generated simultaneously by one planar antenna, two transmission and reception units integrated in an integrated circuit are respectively connected to two feeding points disposed at positions different from each other in the one planar antenna.

When power is supplied to two-polarized-waves shared planar antennas, it is required that wirings to respective feed points of the same polarized waves be made equal in length in order to make the characteristics of the same polarized waves between the planar antennas equal. However, in order to make wirings from respective transmission and reception units to the corresponding feeding points equal in length, wirings of complicated shapes are required, which causes a problem that wiring loss increases and a man-hour for designing increases.

SUMMARY

The present disclosure has been made in view of the above-described problem and an object thereof is to provide a polarized wave shared array antenna in which wirings from a plurality of transmission and reception units integrated in an integrated circuit to respective feeding points of polarized wave shared planar antennas are equal in length without making the shapes of the wirings complicated, and a method for manufacturing the same.

A polarized wave shared array antenna according to an aspect of the present disclosure includes: a first planar antenna and a second planar antenna provided adjacent to each other on one surface of an antenna substrate, each of the first and the second planar antennas being configured to generate two polarized waves of a first polarized wave and a second polarized wave orthogonal to each other; a first feeding point for generating the first polarized wave and a second feeding point for generating the second polarized wave, the first and the second feeding points being provided in the first planar antenna; a third feeding point for generating the first polarized wave and a fourth feeding point for generating the second polarized wave, the third and the fourth feeding points being provided in the second planar antenna; and an integrated circuit including a first transmission and reception unit to a fourth transmission and reception unit provided on the other surface of the antenna substrate, the first to the fourth transmission and reception units, respectively, being connected to the first to the fourth feeding points via a first wiring to a fourth wiring, respectively, in which in a plan view, with respect to a first axis that passes through a center of the first and the second planar antennas, the first and the second feeding points, respectively, are disposed symmetrical to the third and the fourth feeding points, and the first and the second transmission and reception units, respectively, are disposed symmetrical to the third and the fourth transmission and reception units.

A method for manufacturing a polarized wave shared array antenna according to an aspect of the present disclosure includes: providing a first planar antenna and a second planar antenna so as to be adjacent to each other on one surface of an antenna substrate, each of the first and the second planar antennas being configured to generate two polarized waves of a first polarized wave and a second polarized wave orthogonal to each other; providing a first feeding point for generating the first polarized wave and a second feeding point for generating the second polarized wave in the first planar antenna; providing a third feeding point for generating the first polarized wave and a fourth feeding point for generating the second polarized wave in the second planar antenna; providing an integrated circuit including a first transmission and reception unit to a fourth transmission and reception unit on the other surface of the antenna substrate, the first to the fourth transmission and reception units, respectively, being connected to the first to fourth feeding points via a first wiring to a fourth wiring, respectively; and disposing the first and the second feeding points, respectively, so as to be symmetrical to the third and the fourth feeding points with respect to a first axis that passes through a center of the first and the second planar antennas in a plan view, and disposing the first and the second transmission and reception units, respectively, so as to be symmetrical to the third and the fourth transmission and reception units with respect to the first axis that passes through the center of the first and the second planar antennas in the plan view.

BRIEF DESCRIPTION OF DRAWINGS

The above and other aspects, features and advantages of the present disclosure will become more apparent from the following description of certain exemplary embodiments when taken in conjunction with the accompanying drawings, in which.

EXAMPLE EMBODIMENTS

Hereinafter, with reference to the drawings, example embodiments of the present disclosure will be described. For the clarification of the explanation, the following description and drawings are omitted or simplified as appropriate. Note that in the figures showing a polarized wave shared array antenna viewed in plan from the side thereof in which an integrated circuit is formed, in order to explain the positional relation between the planar antenna and the integrated circuit, an antenna substrate is made invisible and thus the entirety of the planar antenna and the integrated circuit can be seen.

Figure 5:
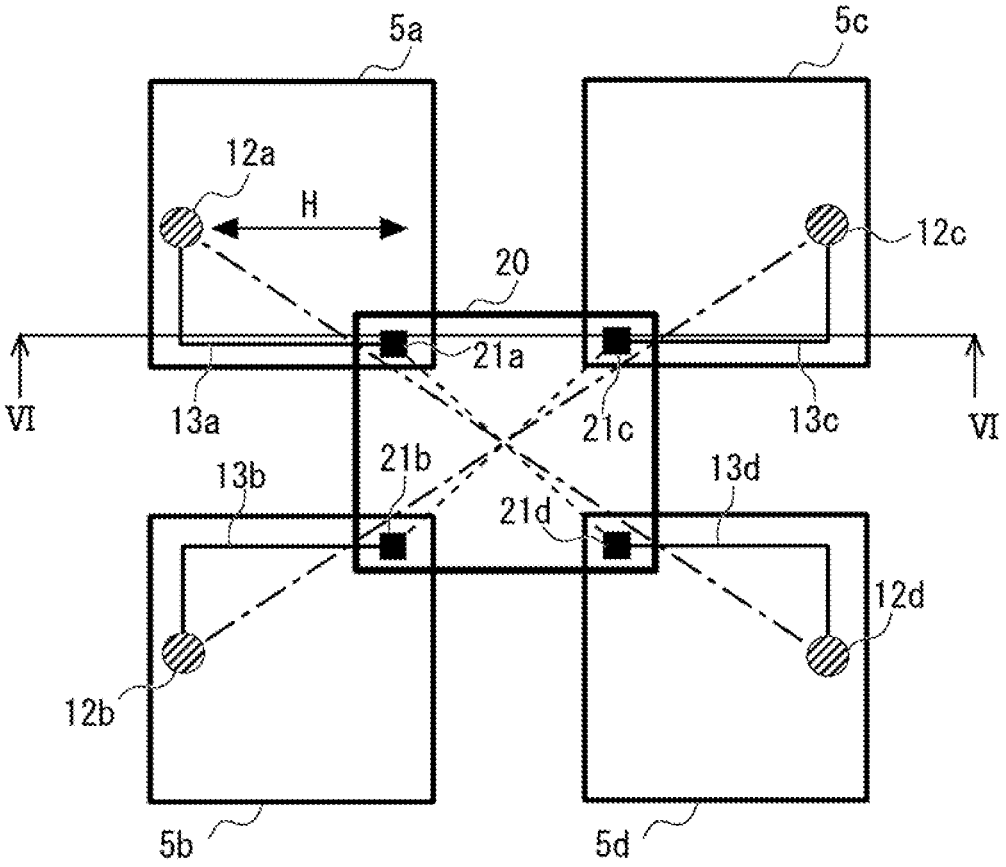
FIG. 5 is a diagram showing a configuration of an antenna according to a comparative example.
Figure 6:
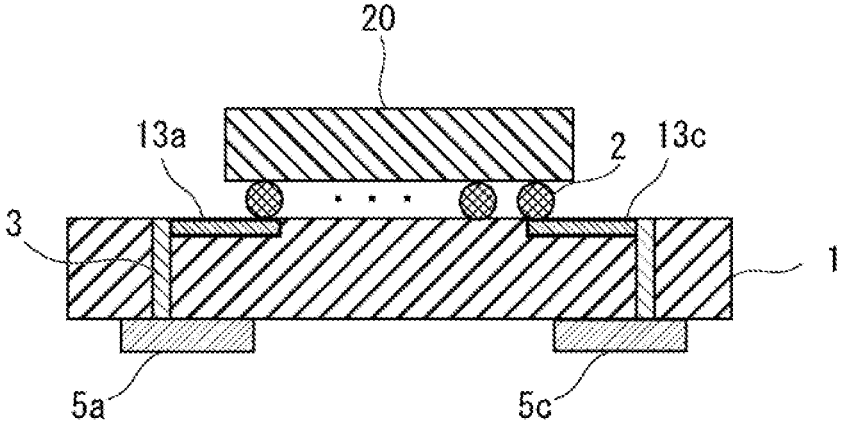
FIG. 6 is a cross-sectional view taken along the line VI-VI of FIG. 5.

Example embodiments relate to a polarized wave shared planar array antenna that generates two orthogonal linear polarized waves. Prior to describing the example embodiments, a problem of a comparative example is described. FIG. 5 is a diagram showing a configuration of an antenna according to the comparative example in which four planar antennas 5*a* to 5*d* are disposed in a 2×2 array. FIG. 6 is a cross-sectional view taken along the line VI-VI of FIG. 5.

As shown in FIG. 6, the planar antennas 5*a* to 5*d* are provided on one surface of an antenna substrate 1 made of a dielectric. Each of the planar antennas 5*a* to 5*d* is a square patch antenna. Each of the planar antenna 5*a* to 5*d*, of which feeding points 12*a* to 12*d* are located so as to be shifted from the center position in the horizontal axis direction in the figure, radiates a polarized wave (an H polarized wave) parallel to the horizontal direction in the figure as shown by a double-headed arrow in FIG. 5.

Further, an integrated circuit 20 is mounted on the other surface of the antenna substrate 1. The integrated circuit 20 includes four transmission and reception units integrated therein, the PADs of transmission and reception units (hereinafter simply referred to as transmission and reception units 21*a* to 21*d*), respectively, are connected to wirings 13*a* to 13*d* via solder 2. Vias 3 are formed in the antenna substrate 1. The wirings 13*a* to 13*d* are connected to the feeding points 12*a* to 12*d* of the planar antennas 5*a* to 5*d* via the vias 3, respectively.

In FIG. 5, the integrated circuit 20 is disposed so that the center point of the four transmission and reception units 21*a* to 21*d* (the point at which a short-dashed line connecting the transmission and reception unit 21*a* to the transmission and reception unit 21*d* intersects a short-dashed line connecting the transmission and reception units 21*b* to the transmission and reception unit 21*c*) and the center position of the feeding points 12*a* to 12*d* (the point at which an alternate long and short dashed line connecting the feeding point 12*a* to the feeding point 12*d* intersects an alternate long and short dashed line connecting the feeding point 12*b* to the feeding point 12*c*) overlap each other. This configuration makes it possible to form the wirings 13*a* to 13*d* connecting the transmission and reception units 21*a* to 21*d* to the feeding points 12*a* to 12*d*, respectively, so that they are equal in length and have the same shape.

Between the antennas (the planar antennas 5*a* and 5*c* and the planar antennas 5*b* and 5*d*) adjacent to each other in the polarized wave direction, the positions of the feeding points are shifted in directions opposite to each other. However, the positions can be corrected by shifting the phase by 180° with a phase shifter included in each of the transmission and reception units of the integrated circuit 20. By doing so, it is possible to maintain the design symmetry excluding variations in the manufacturing and the mounting, thereby improving the accuracy of beamforming.

Figure 7:
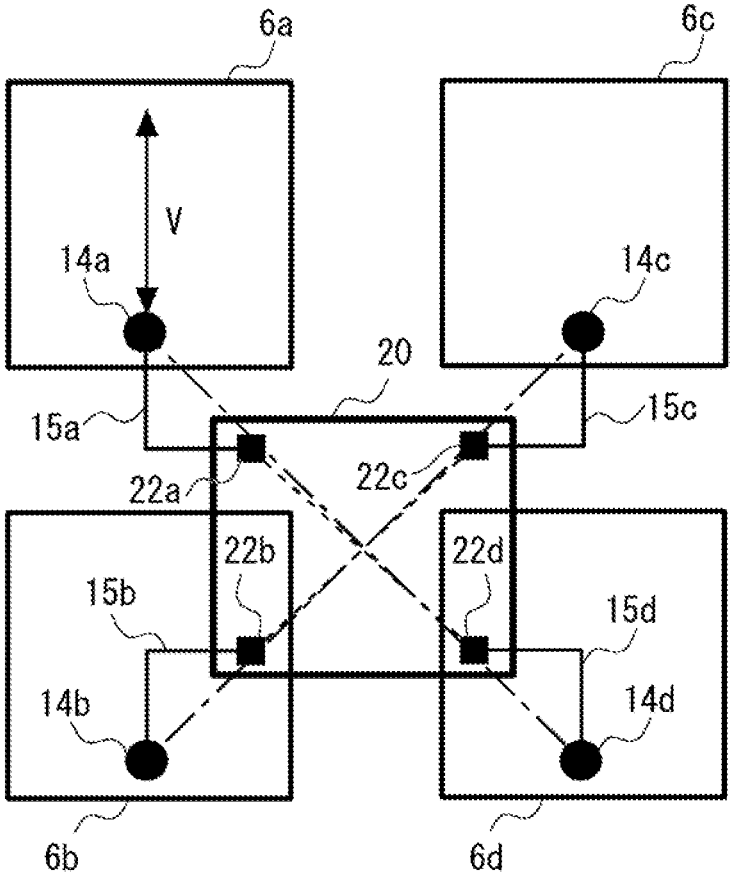
FIG. 7 is a diagram showing the configuration of the antenna according to a comparative example.

Regarding four planar antennas 6*a* to 6*d*, each of which radiates a polarized wave (a V polarized wave) parallel to the vertical direction in the figure as shown by a double-headed arrow in FIG. 7, by disposing the integrated circuit 20 so that the center point of four transmission and reception units 22*a* to 22*d* and the center position of feeding points 14*a* to 14*d* overlap each other as in the case of the antenna of the comparative example arranged in a 2×2 array, it is possible to form wirings 15*a* to 15*d* connecting the transmission and reception units 22*a* to 22*d* to the feeding points 14*a* to 14*d*, respectively, so that they are equal in length and have the same shape.

Figure 8:
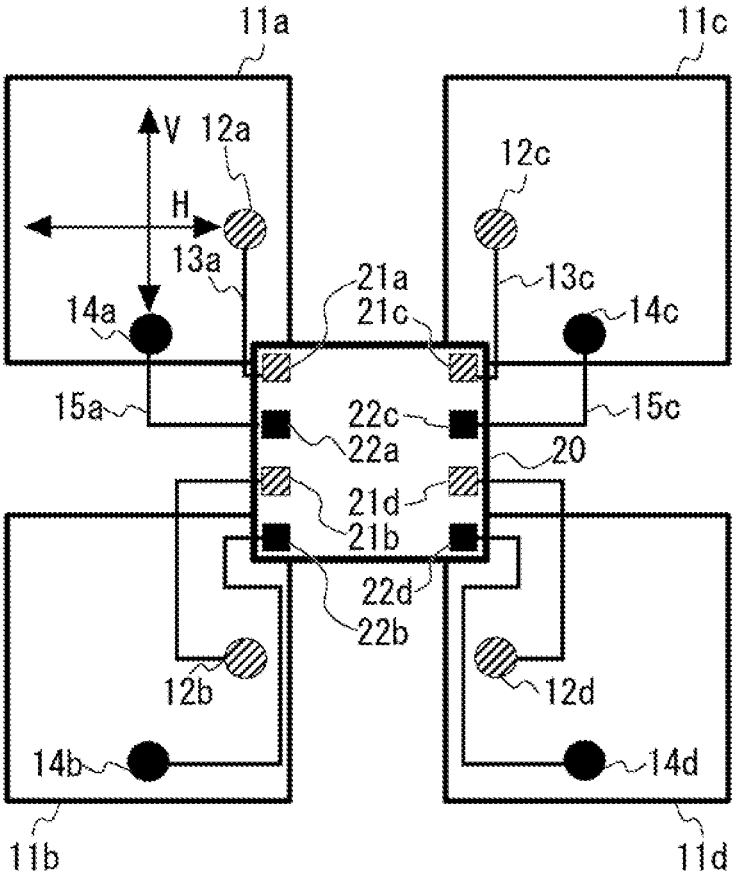
FIG. 8 is a diagram showing the configuration of the antenna according to a comparative example.

FIG. 8 shows a comparative example in which polarized shared planar antennas 11*a* to 11*d*, each of which is a polarized shared planar antenna in which one planar antenna generates two orthogonal polarized waves, are disposed in a 2×2 array. In the example of FIG. 8, the polarized wave directions of the planar antennas 11*a* to 11*d* are parallel to the direction in which the array is arranged. That is, the H polarized wave direction is parallel to the direction in which the planar antennas 11*a* and 11*c* are arranged, and the V polarized wave direction is parallel to the direction in which the planar antennas 11*a* and 11*b* are arranged.

Two transmission and reception units integrated in the integrated circuit 20 are respectively connected to two feeding point disposed at positions different from each other in one planar antenna, in order to generate two types of polarized waves simultaneously in each of the planar antennas 11*a* to 11*d*. For example, in the one planar antenna 11*a*, the two transmission and reception units 21*a* and 22*a* are respectively connected to the two feeding points 12*a* and 14*a* disposed at positions different from each other.

In order to make the characteristics of the two polarized waves of each planar antenna equal when the above-described polarized wave shared planar antennas in which one planar antenna generates two orthogonal polarized waves are arranged in an array, it is desired that all wirings to respective feeding points be made equal in length.

However, as shown in FIG. 8, the center position of the feeding points 12*a* to 12*d* of the two polarized waves, the center position of the feeding points 14*a* to 14*d* of the two polarized waves, and the center point of the four transmission and reception units 21*a* to 21*d* cannot be matched with each other, and thus all the wirings 13*a* to 13*d* and 15*a* to 15*d* that connect the feeding points to the transmission and reception units, respectively, cannot be made equal in length. In order to make all wirings to respective feeding points equal in length, it is necessary to make an extra detour or to intersect signal lines, which causes a problem that wiring loss increases and man-hours for designing increase.

Figure 1:
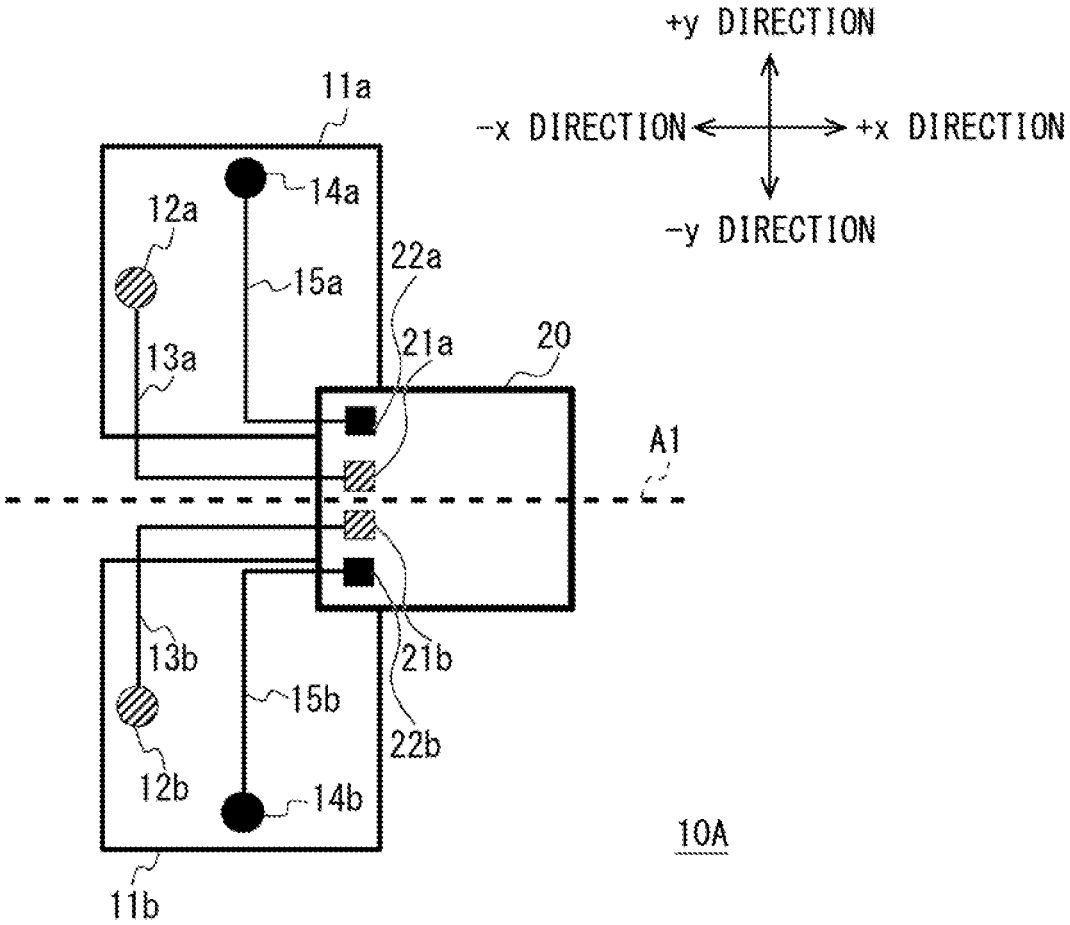
FIG. 1 is a diagram showing a configuration of a polarized wave shared array antenna according to an example embodiment.

To address the above problem, the inventors have conceived the polarized wave shared array antenna described below. FIG. 1 is a diagram showing a configuration example of a polarized wave shared array antenna 10A according to the example embodiment. As shown in FIG. 1, the polarized wave shared array antenna 10A according to the example embodiment includes the planar antennas 11*a* and 11*b* provided adjacent to each other on one surface of the antenna substrate, each of which generating two orthogonal linear polarized waves (the H polarized wave and the V polarized wave). In the example shown in FIG. 1, the planar antennas 11*a* and 11*b* are disposed so as to be arranged in the y direction. It should be noted that the ±x direction is the H polarized wave direction, and the ±y direction is the V polarized wave direction (the same applies to the figures described below).

The feeding point 12*a* for generating the H polarized wave and the feeding point 14*a* for generating the V polarized waves are provided in the planar antenna 11*a*. Further, the feeding point 12*b* for generating the H polarized wave and the feeding point 14*b* for generating the V polarized waves are provided in the planar antenna 11*b*. The integrated circuit 20 is provided on the other surface of the antenna substrate. The transmission and reception units 21*a*, 22*a*, 21*b*, and 22*b* are formed on the integrated circuit 20 and these units, respectively, are connected to the feeding points 12*a*, 14*a*, 12*b*, and 14*b* via the wirings 13*a*, 15*a*, 13*b*, and 15*b*, respectively.

It is assumed in this example that an axis passing through the center of the planar antennas 11*a* and 11*b* is an axis A1. In the example of FIG. 1, in a plan view, the feeding points 12*a* and 14*a*, respectively, are disposed so as to be symmetrical to the feeding points 12*b* and 14*b* with respect to the axis A1. Further, in a plan view, the transmission and reception units 21*a* and 22*a*, respectively, are disposed so as to be symmetrical to the transmission and reception units 21*b* and 22*b* with respect to the axis A1.

In the planar antenna 11*a*, the feeding point 12*a* is disposed in the −x direction, and the feeding point 14*a* is disposed in the +y direction orthogonal to the −x direction. Further, in the planar antenna 11*b*, the feeding point 12*b* is disposed in the −x direction, and the feeding point 14*b* is disposed in the −y direction opposite to the +y direction.

The transmission and reception units 22*a*, 21*a*, 21*b*, and 22*b* are disposed in the integrated circuit 20 so as to be arranged in this order in a straight line orthogonal to the axis A1 in a direction from the planar antenna 11*a* toward the planar antenna 11*b*. The feeding point 12*a* is further away from the line where the transmission and reception units 22*a*, 21*a*, 21*b*, and 22*b* are arranged than the feeding point 14*a* is. Further, the feeding point 12*a* is closer to the axis A1 than the feeding point 14*a* is.

Figure 2:
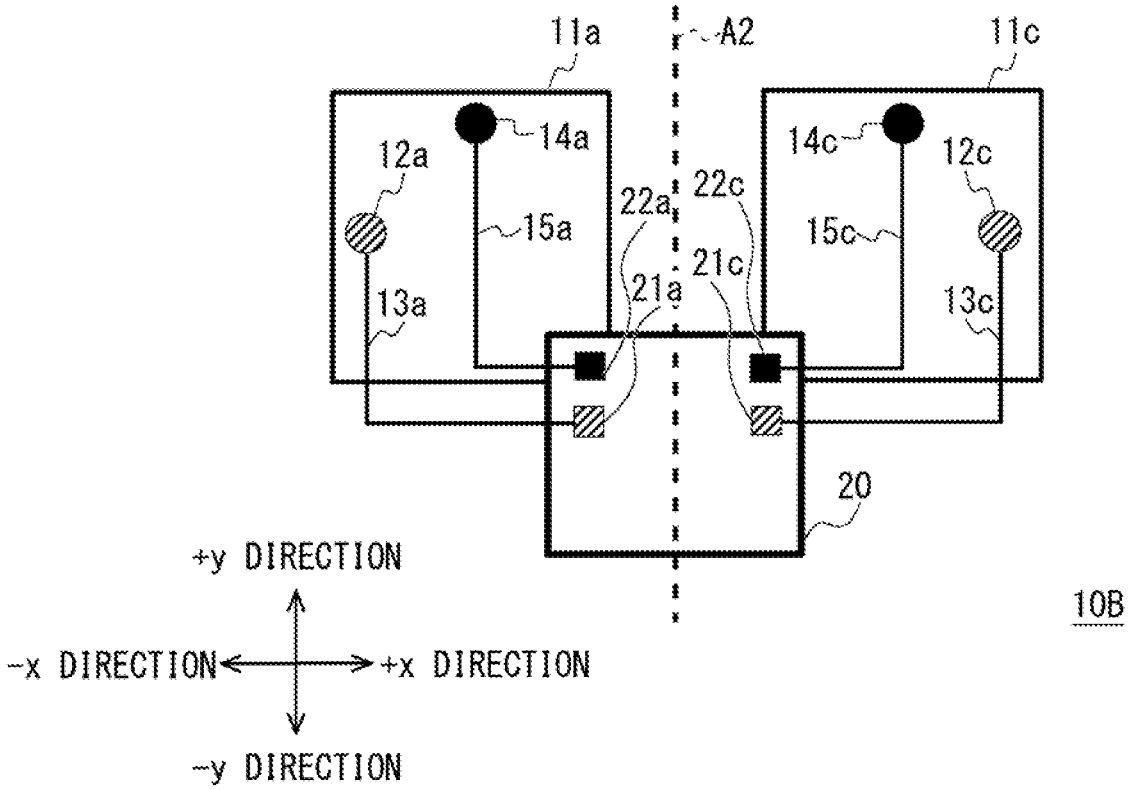
FIG. 2 is a diagram showing a configuration of a polarized wave shared array antenna according to an example embodiment.

FIG. 2 is a diagram showing a configuration example of a polarized wave shared array antenna 10B according to the example embodiment. As shown in FIG. 2, the polarized wave shared array antenna 10B includes the planar antennas 11*a* and 11*c* provided adjacent to each other on one surface of the antenna substrate, each of the planar antennas 11*a* and 11*c* generating two orthogonal linear polarized waves (the H polarized wave and the V polarized wave). In the example shown in FIG. 2, the planar antennas 11*a* and 11*c* are disposed so as to be arranged in the x direction.

It is assumed in this example that an axis passing through the center of the planar antennas 11*a* and 11*c* is an axis A2. In the example of FIG. 2, in a plan view, the feeding points 12*a* and 14*a*, respectively, are disposed so as to be symmetrical to the feeding points 12*c* and 14*c* with respect to the axis A2. Further, in a plan view, the transmission and reception units 21*a* and 22*a*, respectively, are disposed so as to be symmetrical to the transmission and reception units 21*c* and 22*c* with respect to the axis A2.

In the planar antenna 11*a*, the feeding point 12*a* is disposed in the −x direction, and the feeding point 14*a* is disposed in the +y direction orthogonal to the −x direction. Further, in the planar antenna 11*c*, the feeding point 12*c* is disposed in the +x direction opposite to the −x direction, and the feeding point 14*c* is disposed in the +y direction.

The transmission and reception units 22*a* and 21*a* are arranged on a straight line parallel to the axis A2 on the planar antenna 11*a* side of the integrated circuit 20, and the transmission and reception units 22*c* and 21*c* are arranged on a straight line parallel to the axis A2 on the planar antenna 11*c* side of the integrated circuit 20.

By arranging the feeding points and the transmission and reception units that contribute to the respective polarized waves so as to be line-symmetrical to each other, it is possible to make wirings from a plurality of transmission and reception units integrated in the integrated circuit to the respective feeding points of the polarized wave shared planar antennas equal in length without making the shapes of the wirings complicated. Specific example embodiments will be described below.

FIRST EXAMPLE EMBODIMENT

Figure 3:
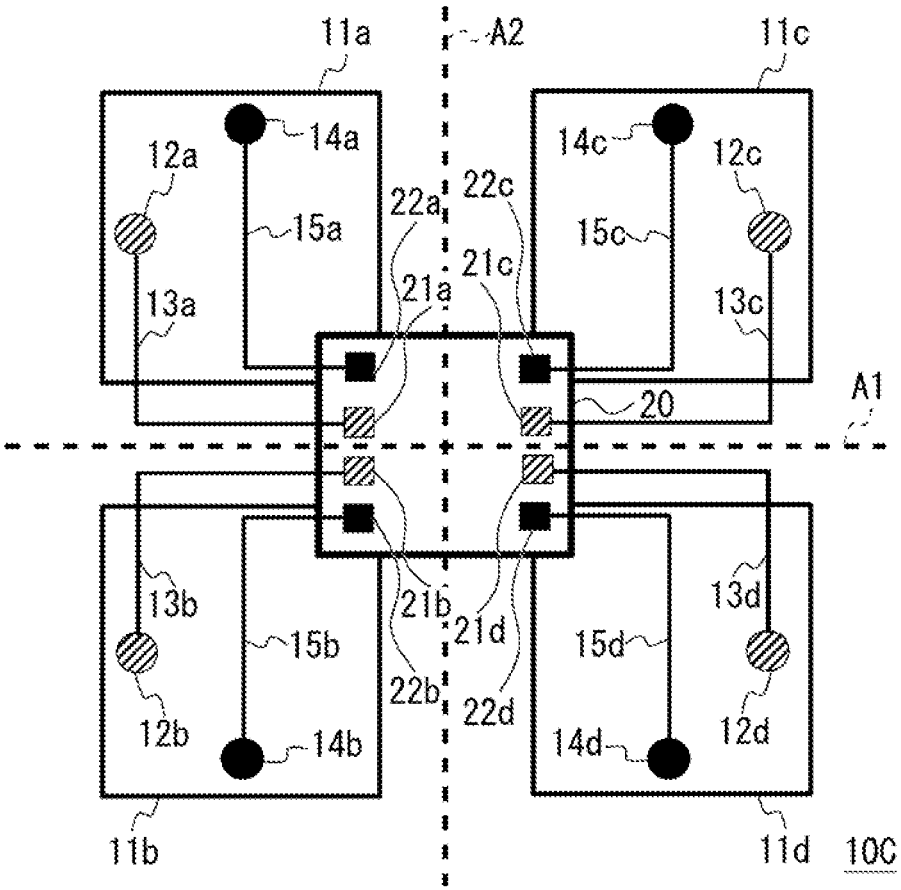
FIG. 3 is a diagram showing an example of a configuration of the polarized wave shared array antenna according to a first example embodiment.
Figure 3:
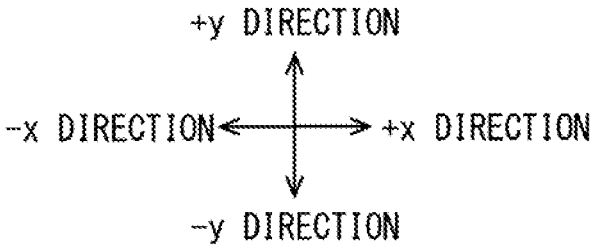

FIG. 3 is a diagram showing a configuration of a polarized wave shared array antenna 10C according to a first example embodiment. The polarized wave shared array antenna 10C shown in FIG. 3 includes the planar antennas 11*a* and 11*b* shown in FIG. 1, and further includes the planar antenna 11*c* adjacent to the planar antenna 11*a* and the planar antenna 11*d* adjacent to the planar antenna 11*b*. Each of the planar antennas 11*a* to 11*d* is a polarized wave shared planar antenna that generates two polarized waves orthogonal to each other. As in the case of the comparative example shown in FIG. 5, the planar antennas 11*a* to 11*d* are arranged in a 2×2 array on one surface of the antenna substrate 1.

The feeding point 12*c* for generating the H polarized wave and the feeding point 14*c* for generating the V polarized waves are provided in the planar antenna 11*c*. Further, the feeding point 12*d* for generating the H polarized wave and the feeding point 14*d* for generating the V polarized waves are provided in the planar antenna 11*d*.

Each antenna is a patch antenna, and is a microstrip antenna including a radiation conductor, a ground conductor, and a dielectric layer interposed between the radiation conductor and the ground conductor. The planar antennas 11*a* to 11*d* are radiation conductors that radiate radio waves and are formed on one surface of the antenna substrate 1 by a conductive layer. Note that a ground conductor is provided on the other surface of the antenna substrate 1 although it is not shown in the figure. The ground conductor functions as a ground of the microstrip antenna and is formed by a conductive layer.

As shown in FIG. 3, each of the planar antennas 11*a* to 11*d* has a square shape. As described above, in each of the planar antennas 11*a* to 11*d*, two feeding points are formed and disposed at positions different from each other. In each of the planar antennas, the two feeding points, respectively, are formed at the central parts of two adjacent sides.

The polarized wave direction of each of the planar antennas 11*a* to 11*d* is the same as the direction in which the array is arranged. That is, the H polarized wave direction is the same as the direction in which the planar antennas 11*a* and 11*c* are arranged, and the V polarized wave direction is the same as the direction in which the planar antennas 11*a* and 11*b* are arranged.

Further, the integrated circuit 20 is mounted on the other surface of the antenna substrate 1. The transmission and reception units 21*a* to 21*d* and the transmission and reception units 22*a* to 22*d* are disposed in the integrated circuit 20. The integrated circuit 20 has a rectangular shape and is disposed so that left and right sides thereof are orthogonal to a straight line A1.

The transmission and reception units 22*a*, 21*a*, 21*b*, and 22*b* are disposed on the left side (the −x side) of the integrated circuit 20 so as to be arranged in this order in a straight line orthogonal to the axis A1 in the direction from the planar antenna 11*a* toward the planar antenna 11*b*. The feeding point 12*a* is further away from the line where the transmission and reception units 22*a*, 21*a*, 21*b*, and 22*b* are arranged than the feeding point 14*a* is. Further, the feeding point 12*a* is closer to the axis A1 than the feeding point 14*a* is.

The transmission and reception units 22*c*, 21*c*, 21*d*, and 22*d* are disposed on the left side (the +x side) of the integrated circuit 20 so as to be arranged in this order in a straight line orthogonal to the axis A1 in the direction from the planar antenna 11*c* toward the planar antenna 11*d*. The feeding point 12*c* is further away from the line where the transmission and reception units 22*c*, 21*c*, 21*d*, and 22*d* are arranged than the feeding point 14*c* is. Further, the feeding point 12*c* is closer to the axis A1 than the feeding point 14*c* is.

It is assumed in this example that an axis passing through the center of the planar antennas 11*a* and 11*c* and the planar antennas 11*b* and 11*d* is the axis A1, and an axis passing through the center of the planar antennas 11*a* and 11*b* and the planar antennas 11*c* and 11*d* is the axis A2. In FIG. 3, in a plan view, with respect to the axis A1, the feeding points 12*a* and 14*a*, respectively, are disposed so as to be symmetrical to the feeding points 12*b* and 14*b*, and the feeding points 12*c* and 14*c*, respectively, are disposed so as to be symmetrical to the feeding points 12*d* and 14*d*. Further, in a plan view, with respect to the axis A2, the feeding points 12*a* and 14*a*, respectively, are disposed so as to be symmetrical to the feeding points 12*c* and 14*c*, and the feeding points 12*b* and 14*b*, respectively, are disposed so as to be symmetrical to the feeding points 12*d* and 14*d*.

Further, in a plan view, with respect to the axis A1, the transmission and reception units 21*a* and 22*a*, respectively, are disposed so as to be symmetrical to the transmission and reception units 21*b* and 22*b*, and the transmission and reception units 21*c* and 22*c*, respectively, are disposed so as to be symmetrical to the transmission and reception units 21*d* and 22*d*. Further, in a plan view, with respect to the axis A2, the transmission and reception units 21*a* and 22*a*, respectively, are disposed so as to be symmetrical to the transmission and reception units 21*c* and 22*c*, and the transmission and reception units 21*b* and 22*b*, respectively, are disposed so as to be symmetrical to the transmission and reception units 21*d* and 22*d*.

As described above, the feeding points and the transmission and reception units of the same polarized waves are disposed symmetrical to each other with respect to the axes A1 and A2. This configuration makes it possible to connect the feeding points to the corresponding transmission and reception units without intersecting the wirings. Thus, it is possible to form the wirings 13*a* to 13*d* so that they are equal in length and have the same shape, and similarly, it is possible to form the wirings 15*a* to 15*d* so that they are equal in length and have the same shape. Accordingly, it is possible to make the characteristics of the same polarized waves between the planar antennas constituting the array equal.

SECOND EXAMPLE EMBODIMENT

Figure 4:
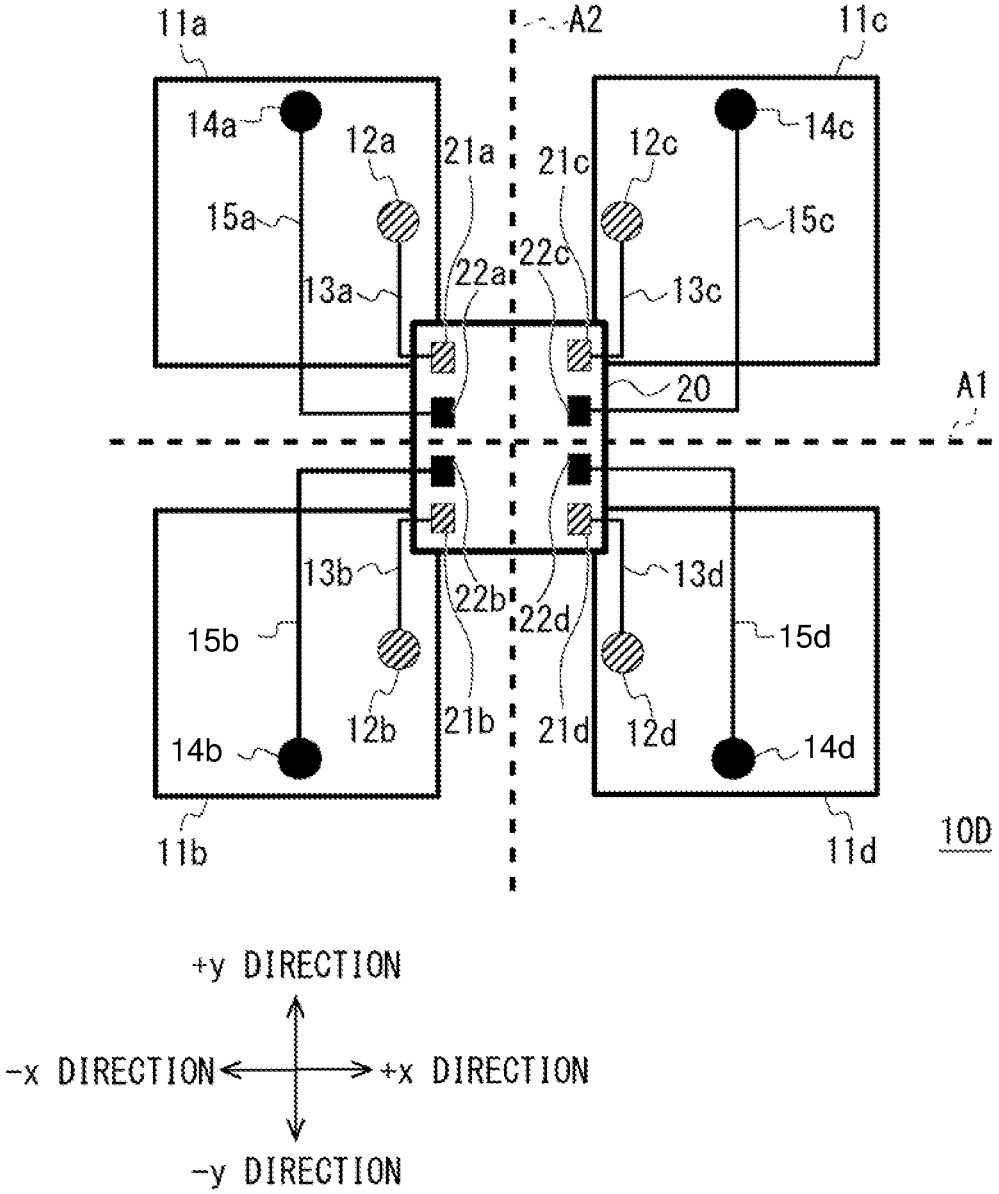
FIG. 4 is a diagram showing an example of a configuration of the polarized wave shared array antenna according to a second example embodiment.

FIG. 4 is a diagram showing a configuration of a polarized wave shared array antenna 10D according to a second example embodiment. The polarized wave shared array antenna 10D differs from the polarized wave shared array antenna according to the first example embodiment in regard to the positions in which the feeding points 12*a* to 12*d*, the transmission and reception units 21*a* to 21*d*, and the transmission and reception units 22*a* to 22*d* are disposed. Note that in the second example embodiment, as in the case of the first example embodiment, the feeding points and the transmission and reception units of the same polarized waves are disposed symmetrical to each other with respect to the axes A1 and A2.

As shown in FIG. 4, the transmission and reception units 21*a*, 22*a*, 22*b*, and 21*b* are disposed on the left side (the −x side) of the integrated circuit 20 so as to be arranged in this order in a straight line orthogonal to the axis A1 in the direction from the planar antenna 11*a* toward the planar antenna 11*b*. The feeding point 12*a* is further away from the line where the transmission and reception units 21*a*, 22*a*, 22*b*, and 21*b* are arranged than the feeding point 14*a* is. Further, the feeding point 12*a* is closer to the axis A1 than the feeding point 14*a* is.

Further, the transmission and reception units 21*c*, 22*c*, 22*d*, and 21*d* are disposed on the left side (the +x side) of the integrated circuit 20 so as to be arranged in this order in a straight line orthogonal to the axis A1 in the direction from the planar antenna 11*c* toward the planar antenna 11*d*. The feeding point 12*c* is further away from the line where the transmission and reception units 21*c*, 22*c*, 22*d*, and 21*d* are arranged than the feeding point 14*c* is. Further, the feeding point 12*c* is closer to the axis A1 than the feeding point 14*c* is.

By changing the positions in which the transmission and reception units 21*a* to 21*d* and the transmission and reception units 22*a* to 22*d* are disposed in accordance with the change in the positional relation between the feeding points 12*a* to 12*d* and the feeding points 14*a* to 14*d* in this way, as in the case of the first example embodiment, it is possible to connect the feeding points to the corresponding transmission and reception units without intersecting the wirings. Thus, it is possible to form the wirings 13*a* to 13*d* so that they are equal in length and have the same shape and form the wirings 15*a* to 15*d* so that they are equal in length and have the same shape, whereby it is possible to make the characteristics of the same polarized waves between the planar antennas constituting the array equal.

As described above, according to the example embodiments, it is possible to form the wirings of the same polarized waves that connect the feeding units to the transmission and receptions unit of the planar antennas in the same shape, whereby it is possible to make the characteristics of the two polarized waves equal and to reduce the loss due to an increase in the wiring length. The example embodiments are used for radio communication devices and are effective particularly in the case of a phased array antenna.

Note that the present disclosure is not limited to the aforementioned example embodiments and may be changed as appropriate without departing from the spirit of the present disclosure. In the aforementioned examples, although a square planar antenna is used, a circular planar antenna or the like may be used. In the above-described figures, all the wirings are bent at right angles, but they may be bent at any angle.

According to the present disclosure, it is possible to provide a polarized wave shared array antenna in which wirings from a plurality of transmission and reception units integrated in an integrated circuit to respective feeding points of polarized wave shared planar antennas are equal in length without making the shapes of the wirings complicated, and a method for manufacturing the same.

The first and second example embodiments can be combined as desirable by one of ordinary skill in the art.

While the disclosure has been particularly shown and described with reference to embodiments thereof, the disclosure is not limited to these example embodiments. It will be understood by those of ordinary skill in the art that various changes in form and details may be made therein without departing from the spirit and scope of the present disclosure as defined by the claims.

What is claimed is:

1. A polarized wave shared array antenna comprising:

a first planar antenna and a second planar antenna provided adjacent to each other on one surface of an antenna substrate, each of the first and the second planar antennas being configured to generate two polarized waves of a first polarized wave and a second polarized wave orthogonal to each other;

a first feeding point for generating the first polarized wave and a second feeding point for generating the second polarized wave, the first and the second feeding points being provided in the first planar antenna;

a third feeding point for generating the first polarized wave and a fourth feeding point for generating the second polarized wave, the third and the fourth feeding points being provided in the second planar antenna; and an integrated circuit comprising a first transmission and reception unit, a second transmission and reception unit, a third transmission and reception unit, and a fourth transmission and reception unit provided on the other surface of the antenna substrate, the first, the second, the third, and the fourth transmission and reception units, respectively, being connected to the first to the fourth feeding points via a first wiring to a fourth wiring, respectively, wherein in a plan view, with respect to a first axis that passes through a center of the first and the second planar antennas, the first and the second feeding points, respectively, are disposed symmetrical to the third and the fourth feeding points, and the first and the second transmission and reception units, respectively, are disposed symmetrical to the third and the fourth transmission and reception units, when viewed from a center of the first planar antenna, the first feeding point is disposed in the first planar antenna in a first direction, and the second feeding point is disposed in the first planar antenna in a second direction orthogonal to the first direction, when viewed from a center of the second planar antenna, the third feeding point is disposed in the second planar antenna in the first direction, and the fourth feeding point is disposed in the second planar antenna in a direction opposite to the second direction, the first transmission and reception unit, the second transmission and reception unit, the fourth transmission and reception unit, and the third transmission and reception unit are arranged in this order on the straight line orthogonal to the first axis in the direction from the first planar antenna toward the second planar antenna, the first feeding point is closer to the straight line than the second feeding point is, and the first feeding point is closer to the first axis than the second feeding point is.

2. The polarized wave shared array antenna according to claim 1, further comprising:

a third planar antenna adjacent to the first planar antenna and a fourth planar antenna adjacent to the second planar antenna, the third and the fourth planar antennas being disposed in a 2×2 array with the first and the second planar antennas;

a fifth feeding point for generating the first polarized wave and a sixth feeding point for generating the second polarized wave, the fifth and the sixth feeding points being provided in the third planar antenna;

a seventh feeding point for generating the first polarized wave and a eighth feeding point for generating the second polarized wave, the seventh and the eighth feeding points being provided in the fourth planar antenna; and a fifth transmission and reception unit, a sixth transmission and reception unit, a seventh transmission and reception unit, and an eighth transmission and reception unit provided in the integrated circuit, the fifth, the sixth, the seventh, and the eighth transmission and reception units, respectively, being connected to the fifth to the eighth feeding points via a fifth wiring to an eighth wiring, respectively, wherein in a plan view, with respect to a second axis that passes through the center of the first and the second planar antennas and a center of the third and the fourth planar antennas, the first and the second feeding points, respectively, are disposed symmetrical to the fifth and the sixth feeding points, the third and the fourth feeding points, respectively, are disposed symmetrical to the seventh and the eighth feeding points, the first and the second transmission and reception units, respectively, are disposed symmetrical to the fifth and the sixth transmission and reception units, and the third and the fourth transmission and reception units, respectively, are disposed symmetrical to the seventh and the eighth transmission and reception units.

3. A method for manufacturing a polarized wave shared array antenna comprising:

providing a first planar antenna and a second planar antenna so as to be adjacent to each other on one surface of an antenna substrate, each of the first and the second planar antennas being configured to generate two polarized waves of a first polarized wave and a second polarized wave orthogonal to each other;

providing a first feeding point for generating the first polarized wave and a second feeding point for generating the second polarized wave in the first planar antenna;

providing a third feeding point for generating the first polarized wave and a fourth feeding point for generating the second polarized wave in the second planar antenna;

providing an integrated circuit comprising a first transmission and reception unit, a second transmission and reception unit, a third transmission and reception unit, and a fourth transmission and reception unit on the other surface of the antenna substrate, the first, the second, the third, and the fourth transmission and reception units, respectively, being connected to the first to fourth feeding points via a first wiring to a fourth wiring, respectively;

disposing the first and the second feeding points, respectively, so as to be symmetrical to the third and the fourth feeding points with respect to a first axis that passes through a center of the first and the second planar antennas in a plan view, and disposing the first and the second transmission and reception units, respectively, so as to be symmetrical to the third and the fourth transmission and reception units with respect to the first axis that passes through the center of the first and the second planar antennas in the plan view;

wherein when viewed from a center of the first planar antenna, the first feeding point is disposed in the first planar antenna in a first direction, and the second feeding point is disposed in the first planar antenna in a second direction orthogonal to the first direction, when viewed from a center of the second planar antenna, the third feeding point is disposed in the second planar antenna in the first direction, and the fourth feeding point is disposed in the second planar antenna in a direction opposite to the second direction, the first transmission and reception unit, the second transmission and reception unit, the fourth transmission and reception unit, and the third transmission and reception unit are arranged in this order on the straight line orthogonal to the first axis in the direction from the first planar antenna toward the second planar antenna, the first feeding point is closer to the straight line than the second feeding point is, and the first feeding point is closer to the first axis than the second feeding point is.

* * * * *